US010662651B2

(12) United States Patent
Jenkins

(10) Patent No.: US 10,662,651 B2
(45) Date of Patent: May 26, 2020

(54) ROOFING SHINGLE WITH UNEVEN EDGE CUT

(71) Applicant: CertainTeed Corporation, Malvern, PA (US)

(72) Inventor: Robert L. Jenkins, Honey Brook, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/500,508

(22) Filed: Sep. 29, 2014

(65) Prior Publication Data

US 2015/0089892 A1 Apr. 2, 2015

Related U.S. Application Data

(60) Provisional application No. 61/919,315, filed on Dec. 20, 2013, provisional application No. 61/884,938, filed on Sep. 30, 2013.

(51) Int. Cl.

| | |
|---|---|
| ***E04D 1/26*** | (2006.01) |
| *E04D 1/20* | (2006.01) |
| *E04D 1/00* | (2006.01) |

(52) U.S. Cl.

CPC ..... *E04D 1/26* (2013.01); *E04D 1/20* (2013.01); *E04D 2001/005* (2013.01)

(58) Field of Classification Search

CPC .... E04D 1/00; E04D 1/08; E04D 1/12; E04D 1/20; E04D 1/26; E04D 2001/005; E04D 2001/3491

See application file for complete search history.

(56) References Cited

U.S. PATENT DOCUMENTS

| | | | | |
|---|---|---|---|---|
| 1,495,070 | A * | 5/1924 | Finley | E04D 1/26 52/555 |
| 2,171,010 | A * | 8/1939 | Schuetz | E04D 1/26 52/105 |
| 2,199,760 | A * | 5/1940 | Sehuetz | E04D 1/265 52/555 |
| 2,437,874 | A | 3/1948 | Black | |
| 3,407,556 | A * | 10/1968 | Leibrook | E04D 1/26 52/559 |
| 3,927,501 | A * | 12/1975 | Allen | E04D 1/26 52/105 |
| 4,499,702 | A * | 2/1985 | Turner | E04D 1/26 52/555 |
| 4,527,374 | A * | 7/1985 | Corbin | E04D 1/26 52/557 |
| 4,717,614 | A | 1/1988 | Bondoc et al. | |
| 6,190,754 | B1 | 2/2001 | Bondoc et al. | |
| 6,457,290 | B1 | 10/2002 | Elliott | |
| 6,692,608 | B2 | 2/2004 | Phillips | |
| 7,240,462 | B2 | 7/2007 | Elliott et al. | |
| 7,665,261 | B2 | 2/2010 | Elliott et al. | |
| 7,861,631 | B2 | 1/2011 | Freshwater et al. | |
| 7,877,949 | B1 | 2/2011 | Elliott | |

(Continued)

*Primary Examiner* — Jessica L Laux

(74) *Attorney, Agent, or Firm* — Abel Schillinger, LLP; Thomas H. Osborn

(57) ABSTRACT

A roofing shingle has side edges, an upper unexposed area, and a lower exposed area. The lower exposed area has a lower edge. The lower edge can include an uneven profile. The uneven profile can include a symmetry element. The symmetry element can only pertain to the course of the uneven profile.

14 Claims, 10 Drawing Sheets

(56) References Cited

U.S. PATENT DOCUMENTS

| | | | | |
|---|---|---|---|---|
| 8,209,938 | B2 | 7/2012 | Gaudreau et al. | |
| 2004/0079042 | A1* | 4/2004 | Elliott | E04D 1/26 52/557 |
| 2004/0111996 | A1* | 6/2004 | Heroneme | B32B 7/04 52/518 |

* cited by examiner

AB 5 inch offset from right

ABAB
ABAB

ABAB
BABA 5 inch offset

BBBB
AAAA 5 inch offset

AB 10 inch offset from right

ABAB
ABAB

ABAB
ABAB 10 inch offset

BBBB
AAAA 10 inch offset

ROOFING SHINGLE WITH UNEVEN EDGE CUT

CROSS-REFERENCE TO RELATED APPLICATION(S)

This application claims priority under 35 U.S.C. § 119(e) to U.S. Patent Application No. 61/884,938 entitled "Roofing Shingle with Uneven Edge Cut," by Robert L. Jenkins, filed Sep. 30, 2013, and this application claims priority under 35 U.S.C. § 119(e) to U.S. Patent Application No. 61/919,315 entitled "Roofing Shingle with Uneven Edge Cut," by Robert L. Jenkins, filed Dec. 20, 2013 of which are both assigned to the current assignee hereof and incorporated herein by reference in their entirety.

BACKGROUND OF THE INVENTION

Field of the Disclosure

The present invention relates in general to roofing shingles and roof covering assemblies thereof. More particularly, it relates to a multitab strip shingle, which, when assembled with other identical and complementary roofing shingles in an overlapping manner with lateral offset, the pattern exhibits appearance of a natural slate or wood shake shingle roof, with shingles having random widths and multiple lengths.

Description of the Related Art

Many attempts have been made to produce the conventional granule surfaced asphalt saturated roofing shingle in a form which simulates the appearance of natural slate or wood shingle roof, i.e. a pattern having shingles with random widths and lengths. These attempts have usually taken the form of multiple tabs of differing widths along the lower exposed surface of the conventional strip shingle, as disclosed in U.S. Pat. No. 4,499,702, for example, and also include the use of mirror image pairs of strip shingles as disclosed in U.S. Pat. No. 3,927,501 in order to improve the randomness of the assembled pattern. However, these attempts have proved to be somewhat deficient in producing the desired random pattern. Especially, when viewed in a diagonal direction, the observer can easily detect the periodicity of the pattern.

Accordingly, it is an object of the present invention to provide a novel multitab roofing shingle wherein identical and complementary shingles can be assembled on a roof in a predetermined assembly to simulate the random appearance of natural wood shake shingles.

SUMMARY

In a first aspect, a roofing shingle has side edges, an upper unexposed area, and a lower exposed area. The lower exposed area has a lower edge. The lower edge can include an uneven profile. The uneven profile can include a symmetry element. The symmetry element can pertain only to the course of the uneven profile.

In a second aspect, a roofing shingle has side butt edges, an upper unexposed area, and a lower exposed area. The roofing shingle can have at least n slots. The n slots define n+1 tabs. Each tab can have a nominal length and a lower edge. The lower edge of at least n−1 tabs can include at least one offset from the nominal length.

In a third aspect, a roofing shingle assembly includes a first set of roofing shingles. Each roofing shingle of the first set has side butt edges, an unexposed area, and an exposed area. Each roofing shingle of the first set can have at least n slots defining at least n+1 tabs. The roofing shingle assembly can further include a second set of roofing shingles. Each roofing shingle has side butt edges, an unexposed area, and an exposed area. Each roofing shingle of the second set can have at least m slots defining at least m+1 tabs. The first and the second set can include a complementary join at the exposed area. At least one of the n slots and at least one of the m slots may not be aligned across the complementary join.

In a fourth aspect, a roof of a building has roofing shingles. The roofing shingles can comprise a substrate, a top asphalt layer overlying the substrate, granular matter. The roofing shingles can further include side butt edges, an upper unexposed area, and a lower exposed area. The roofing shingles can further include at least n slots defining at least n+1 tabs. Each tab can have a nominal length and a lower edge. The lower edge of at least n−1 tabs can include at least one offset from the nominal length.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

In one embodiment, a roofing shingle has side edges, an upper unexposed area, and a lower exposed area. The lower exposed area has a lower edge. The lower edge can include an uneven profile. The uneven profile can include a symmetry element. The symmetry element can pertain only to the course of the uneven profile.

In another embodiment, a roofing shingle has side butt edges, an upper unexposed area, and a lower exposed area. The roofing shingle can have at least n slots. The n slots define n+1 tabs. Each tab can have a nominal length and a lower edge. The lower edge of at least n−1 tabs can include at least one offset from the nominal length.

In yet one further embodiment, a roofing shingle assembly includes a first set of roofing shingles. Each roofing shingle of the first set has side butt edges, an unexposed area, and an exposed area. Each roofing shingle of the first set can have at least n slots defining at least n+1 tabs. The roofing shingle assembly can further include a second set of roofing shingles. Each roofing shingle has side butt edges, an unexposed area, and an exposed area. Each roofing shingle of the second set can have at least m slots defining at least m+1 tabs. The first and the second set can include a complementary join at the exposed area. At least one of the n slots and at least one of the m slots may not be aligned across the complementary join.

In another embodiment, a roof of a building has roofing shingles. The roofing shingles can comprise a substrate, a top asphalt layer overlying the substrate, granular matter. The roofing shingles can further include side butt edges, an upper unexposed area, and a lower exposed area. The roofing shingles can further include at least n slots defining at least n+1 tabs. Each tab can have a nominal length and a lower edge. The lower edge of at least n−1 tabs can include at least one offset from the nominal length.

Figure 1:
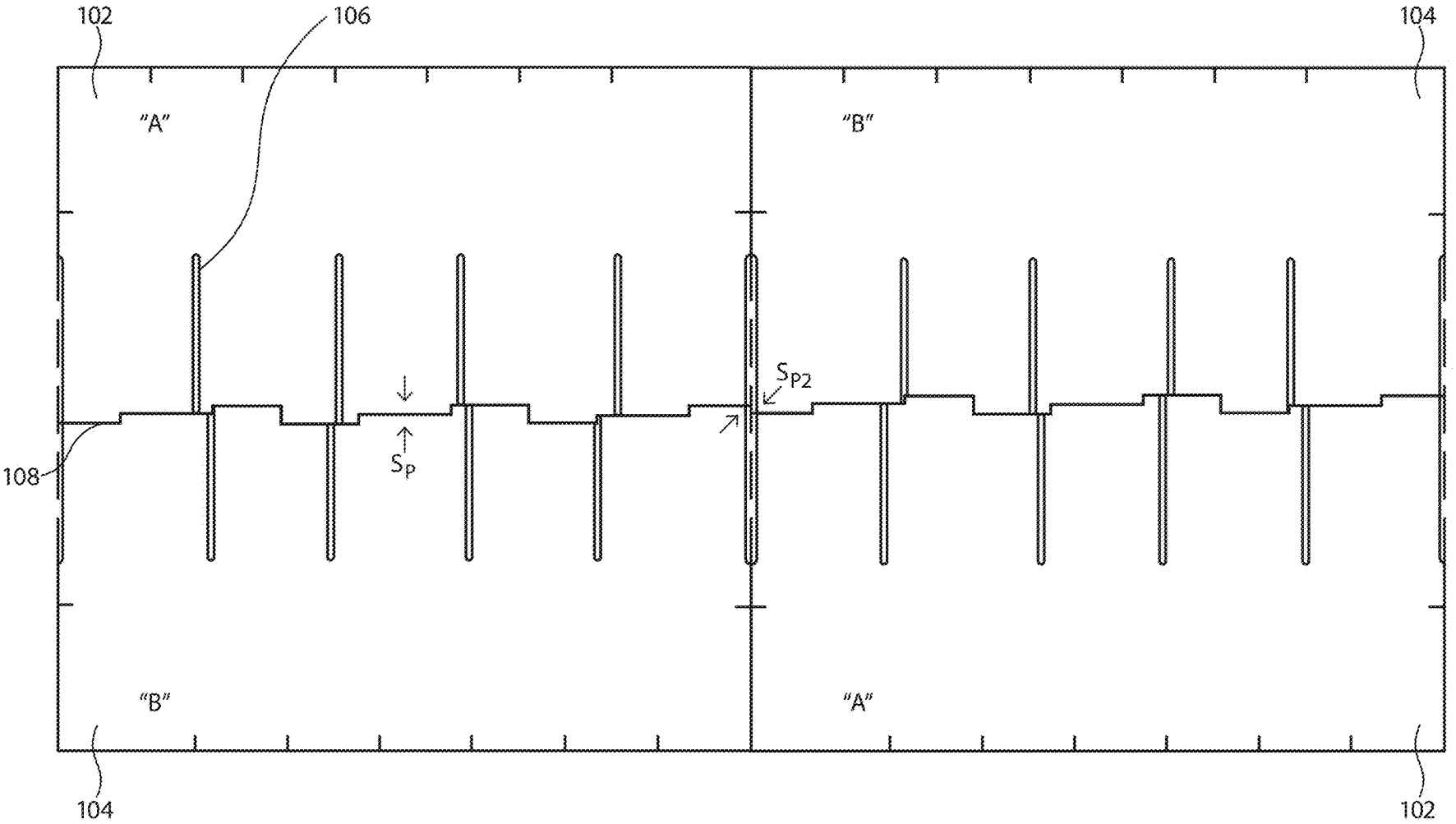
FIG. 1 is a view of a roofing shingle assembly of two sets of roofing shingles "A" and "B".

FIG. 1 depicts a roofing shingle assembly comprising two sets of type A 102 and type B 104 roofing shingles. Roofing shingles A and B are complementary to each other, i.e., they share a common join line 108 over the entire length of the double set. This roofing shingle assembly can be prepared from a fixed cutting cylinder, stamping plate, or other conventional mechanism in a repeatable manner.

The join line 108 is uneven, i.e., the line is not a continuous straight line. Join line can be segmented forming offsets into or from the roofing shingle. These offsets can be rectangular or step-like in shape. In other embodiments, the offsets can be trapezoidal in shape. In yet another embodiment, the offsets can be a combination of the foregoing shapes.

In embodiments, join line 108 has one or more symmetry elements. For example, as shown in FIG. 1, the roofing shingles A and B have a join line with a point of inversion in point $S_P$. Moreover, the horizontally adjacent roofing shingles A and B have another point of inversion in point $S_{P2}$. In other elements, join line 108 can have additional or alternative symmetry elements. For example, the join line 108 can have axis of rotation, a mirror plane, a center of inversion, or any combination of such symmetry elements.

The roofing shingle further includes slots 106. These slots can be partially cut into the roofing shingle, i.e. only portions of the roofing material are removed. Alternatively, the slots can be free of roofing materials, thereby forming gaps between portions of the roofing shingles.

As shown in FIG. 1, except for the central slot in the assembly, none of the slots 106 within a roofing shingle "A" or "B" is aligned. In other embodiments, two slots within complementary roofing shingles may be aligned.

Figure 2A:
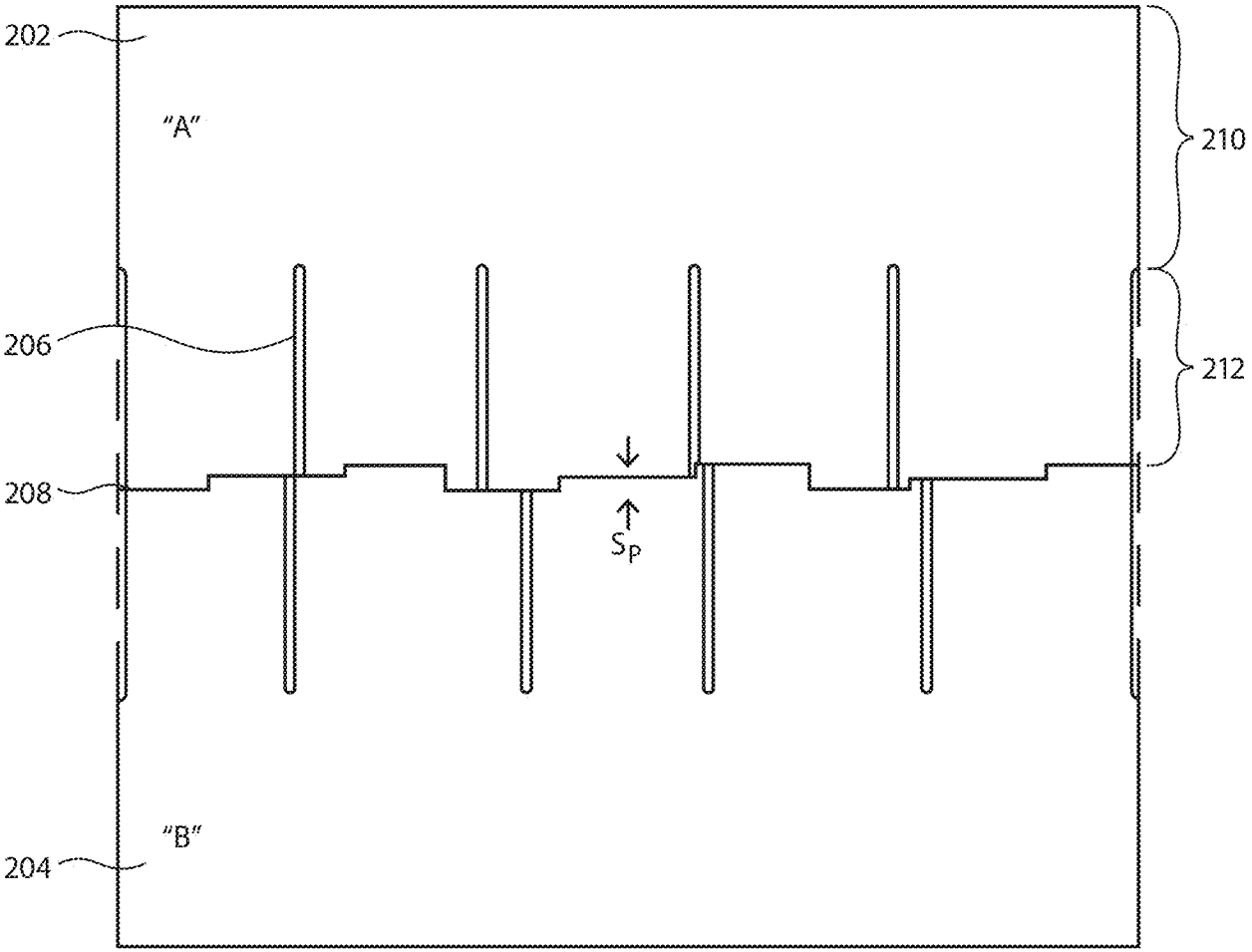
FIG. 2A is one exemplary assembly of two complementary roofing shingles "A" and "B", having a symmetric join and nonaligned slots
Figure 2B:
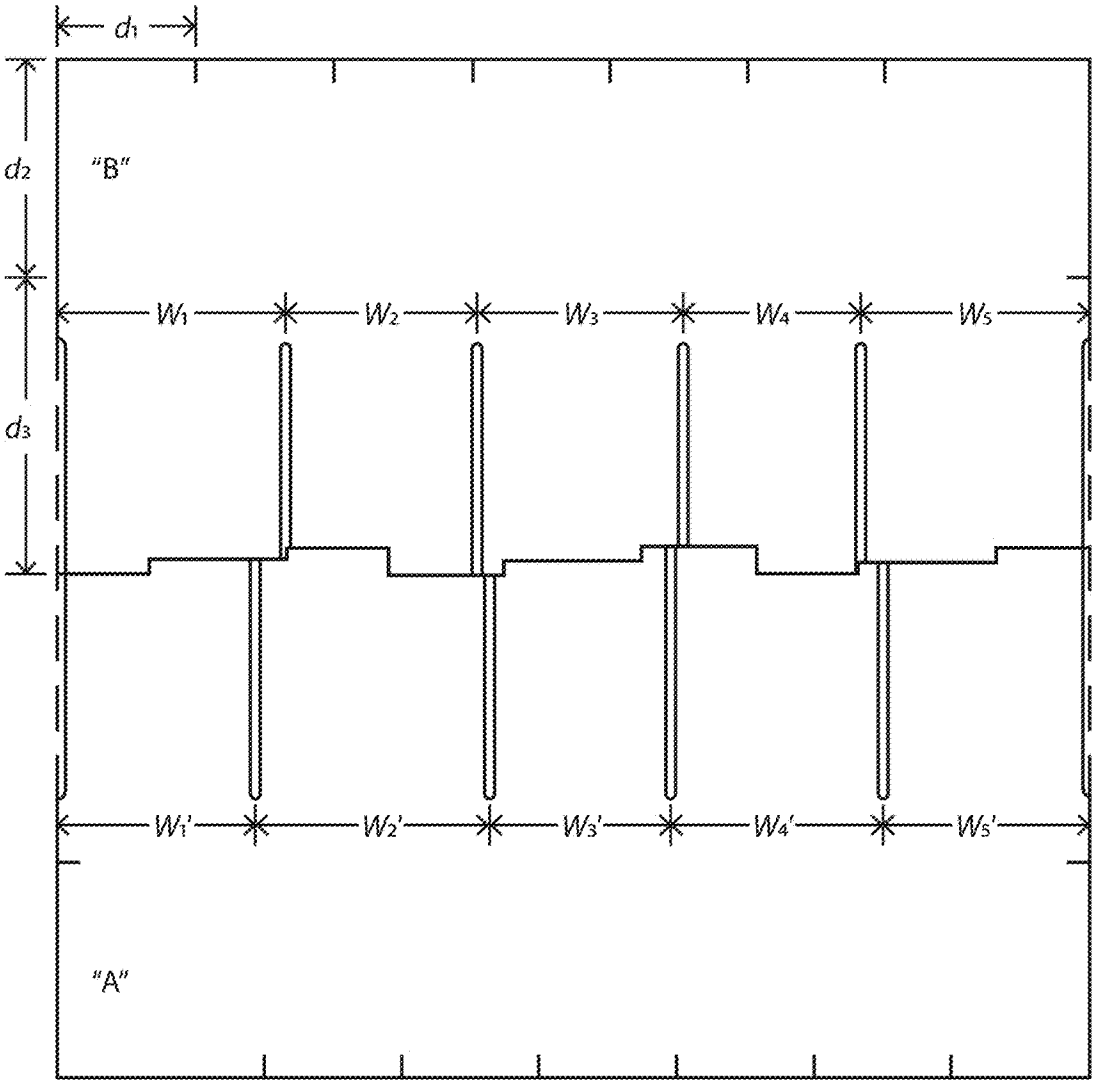
FIG. 2B is another exemplary assembly of two complementary roofing shingles "A" and "B", having a symmetric join and nonaligned slots.

FIGS. 2A and 2B depict two exemplary complementary roofing shingles 202 (type A) and 204 (type B) with join line 208, inversion point SP, located at a midpoint of the join line and slots 206, these slots being nonaligned. Area 210 denotes the unexposed upper area of the roofing shingle. Area 212 denotes the lower exposed area.

As can be seen in FIG. 2B, a number n=4 slots define 5 tabs having widths $w_1$, $w_2$, $w_3$, $w_4$, and $w_5$ for roofing shingle "B," and widths $w_1'$, $w_2'$, $w_3'$, $w_4'$, and $w_5'$ for roofing shingle "A." The roofing shingles can further include markings designating distances $d_1$, $d_2$, and $d_3$, which assists in the assembly of the roofing shingles to form a roof. For example $d_1$ can be 5 inches, $d_2$ can be 7 inches, 7.5 inches, 8 inches, 8.5 inches, 9 inches, 9.5 inches, or 10 inches. In some embodiments, the sum of distance $d_3$ and $d_2$ can be 18 inches, 18.5 inches, 19 inches, 19.5, or 20 inches.

Figure 3A:
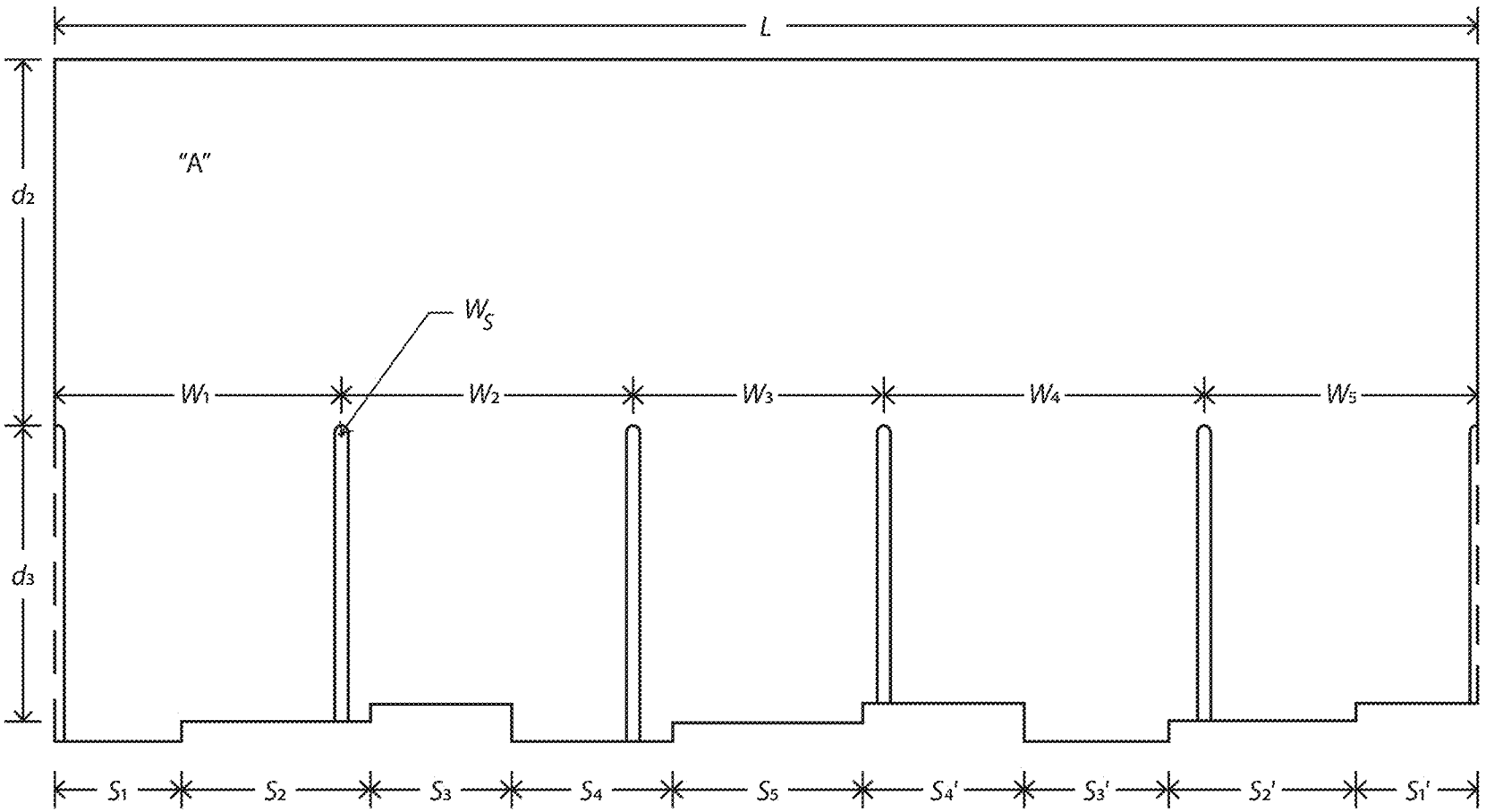
FIGS. 3A-3C are exemplary roofing shingles with a symmetric lower edges.
Figure 3B:
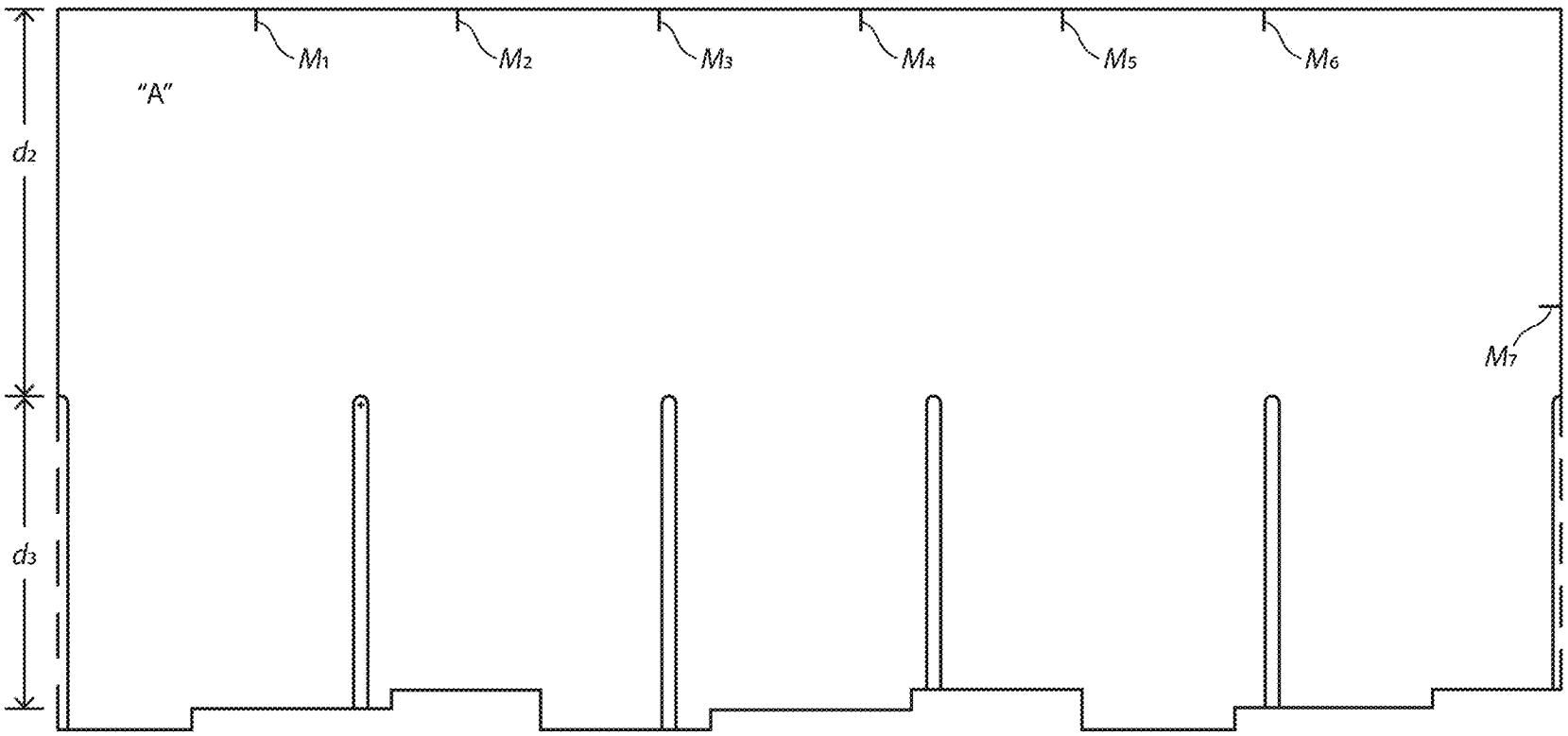
Figure 3C:
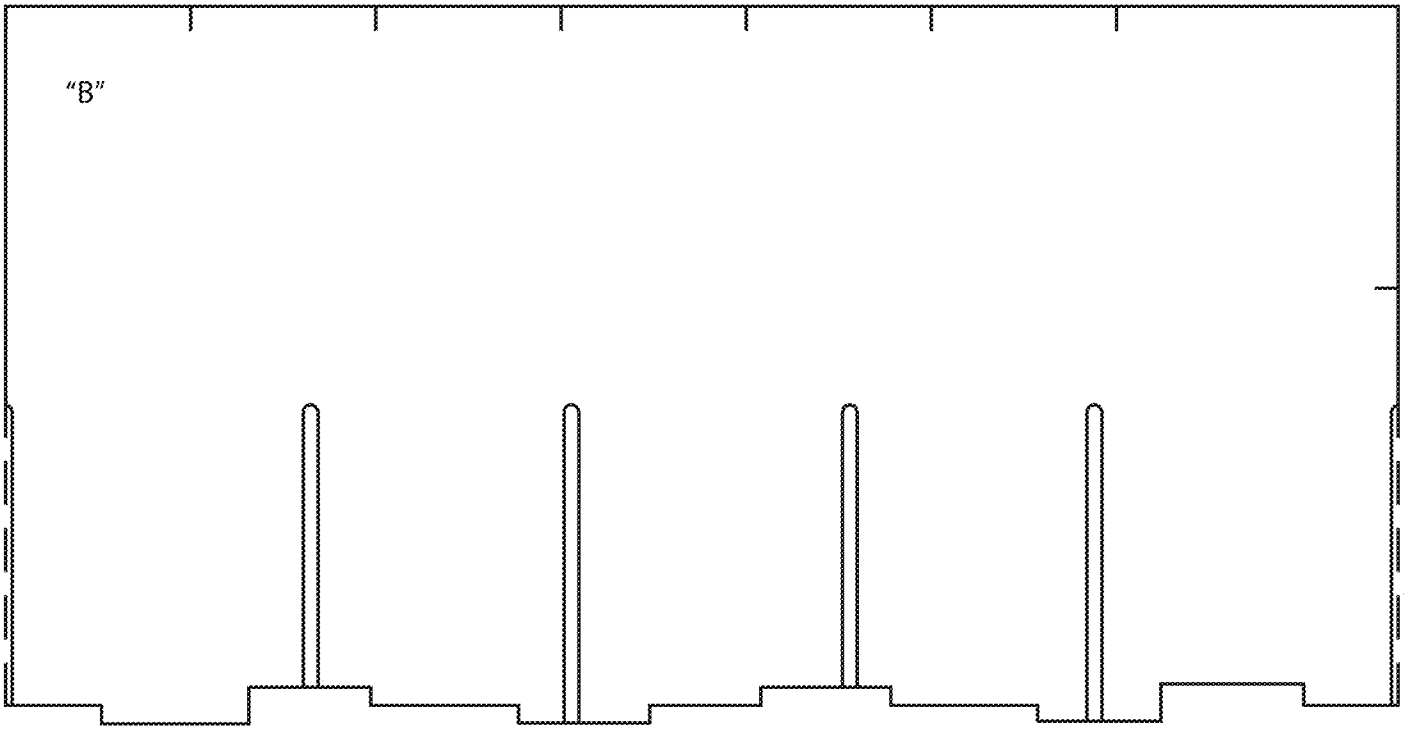

FIGS. 3A-3C disclose exemplary roofing shingles with various dimensions and tab width. All exemplary roofing shingles show a lower edge, as a result from the join line that is segmented from $s_1$, $s_2$, $s_3$, $s_4$, $s_5$, $s_4'$, $s_3'$, $s_2'$, and $s_1'$. The lower edge is rotationally symmetric to the midpoint of $s_5$. Alternatively, each tab has a nominal tab length with at least one offset. The offset can be at least 0.1 inches, at least about 0.2 inches, at least about 0.3 inches, at least about 0.35 inches, at least about 0.4 inches, or at least about 0.45 inches. In other embodiments, the tab offset is not greater than 1.1 inches, such as not greater than 1.0 inches, not greater than 0.9 inches, not greater than 0.8 inches, not greater than 0.7 inches, not greater than 0.6 inches, not greater than 0.5 inches, or not greater than 0.4 inches.

In embodiments, the roofing shingle can have an exposed area with at least n slots defining at least n+1 tabs. The n+1 tabs each having a width $w_1$ through $w_{n+1}$. In some embodiments, n is at least 2, such as 3, 4, 5, or 6. In a particular embodiment and as shown in the FIGS. n is 4. In one embodiment, at least one of the widths $w_1$ through $w_{n+1}$ is unequal to another width. Therefore, it is contemplated that in some embodiments at least two widths are the same. In yet another embodiment, each width $w_1$ through $w_{n+1}$ is unequal to another width, i.e. no two widths are the same.

In embodiments, any one of the widths $w_1$ through $w_{n+1}$ is at least about 5 inches, at least about 5.25 inches, at least about 5.5 inches, at least about 5.75 inches, at least about 6 inches, at least about 6.25 inches, at least about 6.5 inches, at least about 6.75 inches, at least about 7 inches, at least about 7.25 inches, at least about 7.5 inches, at least about 7.75 inches, or at least 8 inches. In further embodiments, any one of the widths $w_1$ through $w_{n+1}$ is not greater than about 10 inches, not greater than about 9.75 inches, not greater than about 9.5 inches, not greater than about 9.25 inches, not greater than about 9 inches, not greater than about 8.75 inches, not greater than about 8.5 inches, not greater than about 8.25 inches, not greater than about 8 inches, not greater than about 7.75 inches, not greater than about 7.5 inches, not greater than about 7.25 inches, not greater than about 7 inches, not greater than about 6.75 inches, or not greater than about 6.5 inches.

In a particular embodiment, at least one of $w_1$ through $w_{n+1}$ is in the range from about 6.2 inches to about 6.7 inches. In another embodiment, at least one of $w_1$ through $w_{n+1}$ is in the range from about 7 inches to about 7.5 inches. In yet another embodiment, at least one of $w_1$ through $w_{n+1}$ is in the range from about 7.5 inches to about 8 inches. In one further embodiment, at least one of $w_1$ through $w_{n+1}$ is in the range from about 8 inches to about 8.5 inches. In one further particular embodiment, a first width of $w_1$ through $w_{n+1}$ is in the range from about 6.2 inches to about 6.7 inches, a second width of $w_1$ through $w_{n+1}$ is in the range from about 7 inches to about 7.5 inches, and a third width of $w_1$ through $w_{n+1}$ is in the range from about 8 inches to about 8.5 inches.

The slots 106 or 206 have a slot width $w_s$. In embodiments, $w_s$ is at least about 0.05 inches, at least about 0.1 inches, at least about 0.15 inches, or at least about 0.175 inches. In other embodiments, $w_s$ is not greater than about 1.1 inches, not greater than about 0.9 inches, not greater than about 0.7 inches, not greater than about 0.6 inches, not greater than about 0.5 inches, not greater than about 0.4 inches, not greater than about 0.3 inches, not greater than about 0.25 inches, not greater than about 0.225 inches, or not greater than about 0.2 inches.

Each tab formed by the slots has a nominal length $l_t$. In embodiments, $l_t$ can be at least 6 inches, such as at least 6.5 inches, at least 7 inches, at least 7.5 inches, at least 8 inches, at least 8.5 inches, or at least 9 inches. In other embodiments, $l_t$ can be not greater than 14 inches, such as not greater than 13.5 inches, not greater than 13 inches, not greater than 12.5 inches, not greater than 12 inches, not greater than 11.5 inches, not greater than 11 inches, not greater than 10.5 inches, not greater than 10 inches, not greater than 9.5 inches.

In embodiments, the offset at the lower edge of the shingle varies from the nominal length between +/−10%, between +/−9%, between +/−8%, between +/−7.5%, between +/−7%, between +/−6.5%, between +/−6%, between +/−5.5%, or between +/−5%. In one particular embodiment, the tab has one offset greater than the nominal length. In one further particular embodiment, the tab has one offset less than the nominal length. In one particular embodiment, the tab has two offsets, one greater than the nominal length, one less than the nominal length.

In embodiments addressing roofs, the exposed area of a first roofing shingle can cover a portion of the unexposed area of a second roofing shingle. The portion can be at least 10%, at least 20%, at least 30%, at least 40%, at least 45%, or at least 50% of the unexposed area. In other embodiments, the portion is not greater than 100%, not greater than 90%, not greater than 80%, not greater than 70%, not greater than 60% of the unexposed area. In yet one further embodiment, none of the slots of the first roofing shingle align with any of the slots of the second roofing shingle.

Figure 4A:
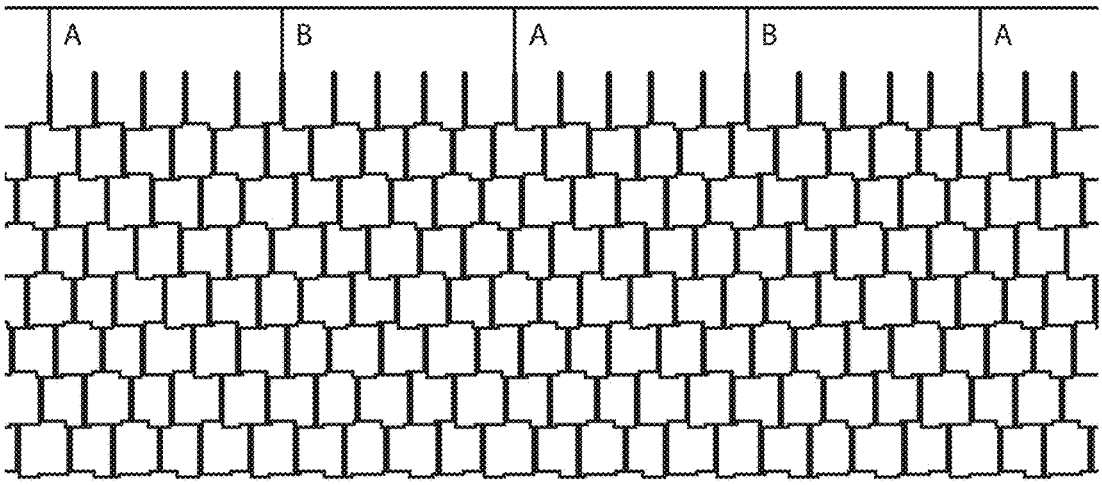
FIGS. 4A-4C and 5A-5C disclose examples of resulting patterns for a roof comprising the roofing shingles.
Figure 4B:
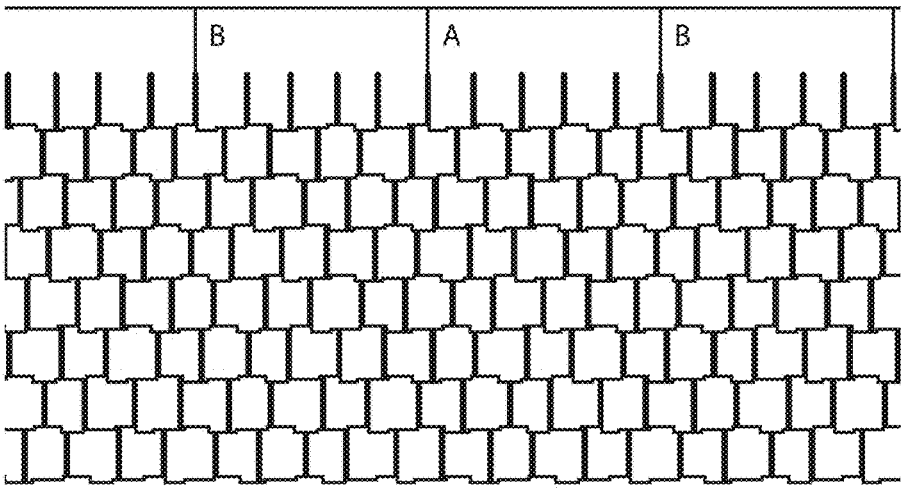
Figure 4C:
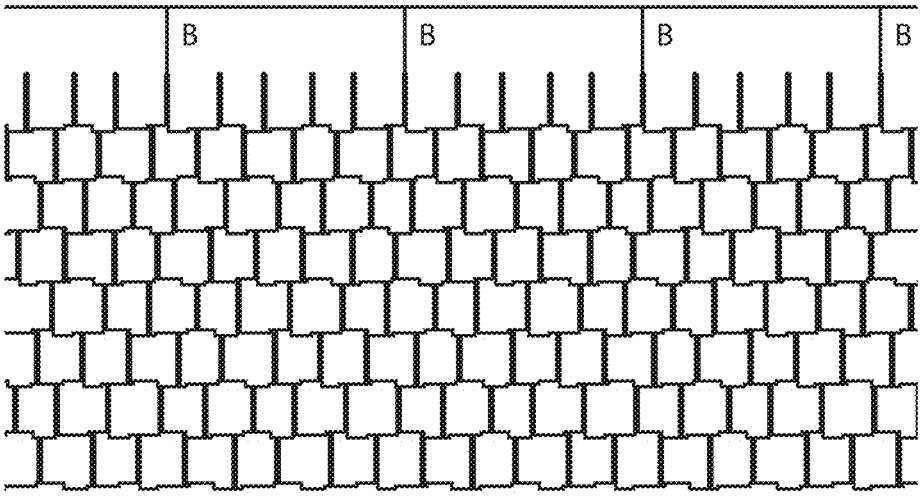
Figure 5A:
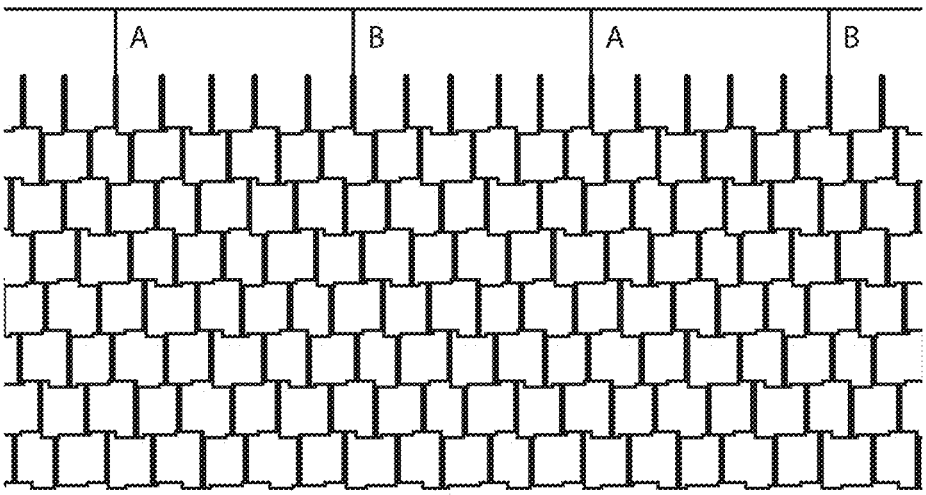
Figure 5B:
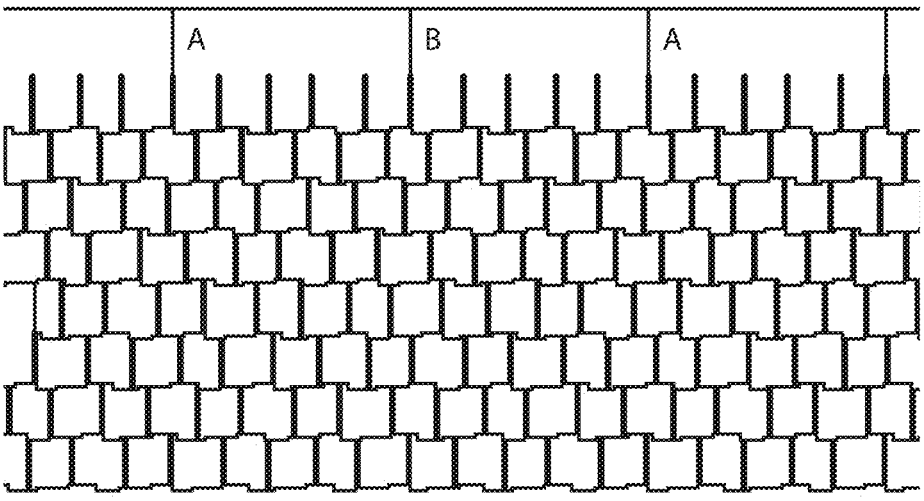
Figure 5C:
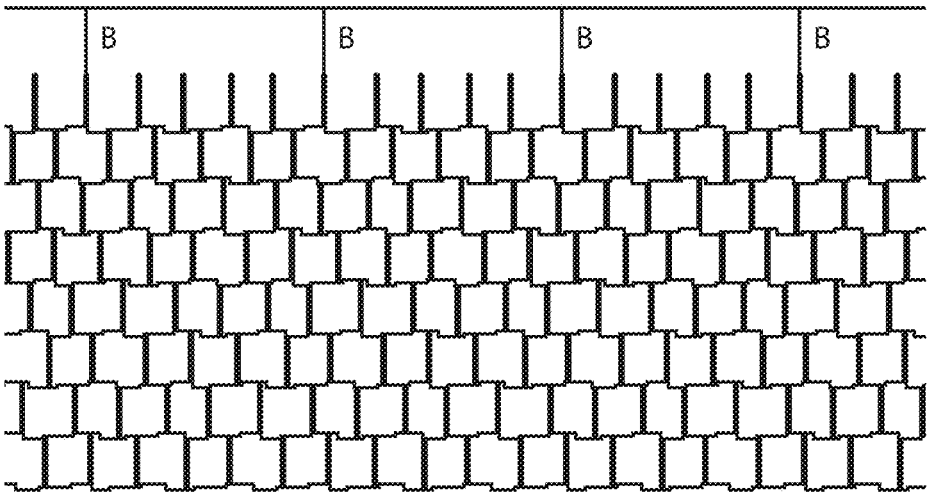

FIGS. 4A through C and 5A through C disclose the resulting pattern for a roof with alternating type A and type B roofing shingles in a course apart by a lateral offset of 5 inches and 10 inches, respectively, between upper and lower courses in a stair step installation fashion. In the figures, shingles of an overlying course are laterally offset by a distance of 5 or 10 inches leftwardly from the shingle in an underlying course. The lateral offset ensures closure of the roof array at points where two laterally adjacent shingles are installed on the roof. Other lateral offsets may be employed to ensure closure. In some embodiments, the lateral offset is a fraction of an average tab width, or an integral multiple of a fraction of a tab width. In certain embodiments, the lateral offset is selected such that slots between tabs of an overlying shingle do not align with the slots between tabs on an underlying shingle. In FIGS. 4A and 5A, the first course is made up of alternating type A and type B shingles and the next course is made up of alternating type A and type B shingles with a lateral shift to the left of 5 or 10 inches, respectively. The same pattern continues with successive courses up the array, with each course made up of alternating type A and type B shingles. In FIGS. 4B and 5B, the lowest most course is made up of alternating type B and type A shingles and the next course is made up of alternating type A and type B shingles with a lateral shift to the left of 5 or 10 inches, respectively. In the third course, the pattern repeats with alternating B and A shingles, and alternating A and B shingles in the fourth course. That is to say that a type A shingle overlies a type B shingle and a type B shingle overlies a type A shingle throughout the array. In FIGS. 4C and 5C, the first course is all type A shingles and the second course is all type B shingles. The third course repeats with A shingles and the fourth with B shingles, and so on up the roof. While the figures depict a stair step array of shingles with a consistent lateral offset up the roof, other offsets may be employed. For example, an offset could be alternating 5 inches or 10 inches between courses. Further, a racking installation could be employed where a second course is laterally offset 5 or 10 inches to the left of a first course and a third course is laterally offset 5 or 10 inches to the right of the second course to be in alignment with the shingle of the first course, and so on up the roof. A variety of arrangements may be employed for installation of the shingles on the roof to provide a desirable appearance of randomness associated with a natural wood shake roof.

The roofing shingles may have a wide range of colors including beige, yellow, green, brown, dark gray, and potentially other colors while still having a desired reflectivity and emissivity. The roofing shingles may comprise suitable particles of naturally occurring materials such as talc, slag, vitrified materials, granite, silica sand, greenstone, andesite, porphyry, marble, syenite, rhyolite, diabase, greystone, quartz, slate, trap rock, basalt, and marine shells can be used, as well as recycled manufactured materials such as crushed bricks, concrete, porcelain, fire clay, ground rubber or plastic, and the like.

In another embodiment, particles can be added to change the appearance of one tab compared to its neighboring tabs. The combination of the above-described roofing pattern based on the uneven edge in addition with the variation of coloring between tabs, the appearance of a wood shingle roof or shake roof becomes more persuasive.

CIELAB is the second of two systems adopted by CIE in 1976 as models that better showed uniform color spacing in their values. CIELAB is an opponent color system based on the earlier (1942) system of Richard Hunter called L, a, b. Color opposition correlates with discoveries in the mid-1960s that somewhere between the optic nerve and the brain, retinal color stimuli are translated into distinctions between light and dark, red and green, and blue and yellow. CIELAB indicates these values with three axes: L*, a*, and b*. (The full nomenclature is 1976 CIE L*a*b* Space.) The central vertical axis represents lightness (signified as L*) whose values run from 0 (black) to 100 (white). The color axes are based on the fact that a color cannot be both red and green, or both blue and yellow, because these colors oppose each other. On each axis the values run from positive to negative. On the a-a' axis, positive values indicate amounts of red while negative values indicate amounts of green. On the b-b' axis, yellow is positive and blue is negative. For both axes, zero is neutral gray.

For the purposes of this application, articles having a color falling within the inverted conical volume defined by the equation:

$$-(L^*) + \frac{\sqrt{((L_0^*) + (y(a^*)^2 + z(b^*)^2))}}{x} \leq 0 \quad \text{(I)}$$

where $L_0^*=67$, x=1.05, y=1.0, z=1.0 and the values, L*, a*, and b*, are defined on the CIE L*a*b* scale are said to be white and articles having a color falling outside the cone are said to be non-white.

Values of the color space corresponding to white fall within the cone close to the vertical L* axis, are not strongly colored as indicated by their small displacements along either or both of the a* and b* axes, and have a relatively high degree of lightness as indicated by an L* greater than $L_0^*$. $L_0^*$ is the vertex of the cone.

The difference or distance between two colors is a metric of interest in color science. It allows people to quantify a notion that would otherwise be described with adjectives, to the detriment of anyone whose work is color critical. Common definitions make use of the Euclidean distance in a device independent color space. The International Commission on Illumination (CIE) calls their distance metric $\Delta E^*_{ab}$ (also called $\Delta E^*$) used to denote difference of color sensation. Different studies have proposed different $\Delta E$ values that have a JND (just noticeable difference). For roofing products comprising a granular material on asphalt, the products begin to show a JND between $\Delta E$'s of 2.5 and 3.0. These non-uniformities are important because the human eye is more sensitive to certain colors than others. A good metric should take this into account in order for the notion of a "just noticeable difference" to have meaning. Otherwise, a certain $\Delta E$ that may be insignificant between two colors that the eye is insensitive to may be conspicuous in another part of the spectrum. The 1976 formula is the first color-difference formula that related a measured to a known Lab value. Using ($L_2^*$, $a_2^*$, $b_2^*$) and ($L_1^*$, $a_1^*$, $b_1^*$) of two colors in L*a*b*, $\Delta E$ is:

$$\Delta E^* = \sqrt{(L_2^* - L_1^*)^2 + (a_2^* - a_1^*)^2 + (b_2^* - b_1^*)^2}$$

For $\Delta E$ of 3.0 or less there is generally no noticeable difference between the colors, while for a $\Delta E$ of more than 3.0, a color difference becomes noticeable. Since the choice of sand particles varies across the color spectrum and only a small percentage of the shingle comprises exposed asphalt, the color change can be noticeable at lower $\Delta E$, such as at not greater than 2.8, not greater than 2.6, not greater than 2.4, not greater than 2.2, not greater than 2.0, not greater than 1.8, not greater than 1.6, or not greater than 1.4.

In embodiments, the color change $\Delta E$ between two tabs of a roofing shingle can be at least 2.5, such as at least 2.7, at least 3.0, at least 3.5, at least 4.0, at least 4.5, at least 5.0, at least 5.5, at least 6.0, at least 6.5, or even at least 7. In order to ensure that the color changes between two tabs are not too obvious but have the appearance to be the result of natural cause, e.g., weathering, $\Delta E$ can be not greater than 15, such as not greater than 14, not greater than 13, not greater than 12, not greater than 11, not greater than 10, not greater than 9, not greater than 8, or not greater than 7. In some embodiments the color change $\Delta E$ is synchronized with individual tab cuts or transitions. In other embodiments, a granule blend drop yields a zone of color that traverses more than one tab width or a portion of a tab with a gradual transition between adjacent colors to produce the color change $\Delta E$ laterally across the shingle. In some embodiments, the color change $\Delta E$ between two zones of blend drop on a roofing shingle can be at least 2.5, such as at least 2.7, at least 3.0, at least 3.5, at least 4.0, at least 4.5, at least 5.0, at least 5.5, at least 6.0, at least 6.5, or even at least 7. In other embodiments, the color change $\Delta E$ between two zones of blend drop on a roofing shingle can be greater, such as at least 10, at least 16, at least 19, or at least 24. In order to ensure that the color changes between two zones of blend drop on a roofing shingle are not too obvious, $\Delta E$ can be not greater than 48, such as not greater than 37, not greater than 24, not greater than 16, not greater than 11, not greater than 10, not greater than 9, not greater than 8, or not greater than 7.

Figure 6A:
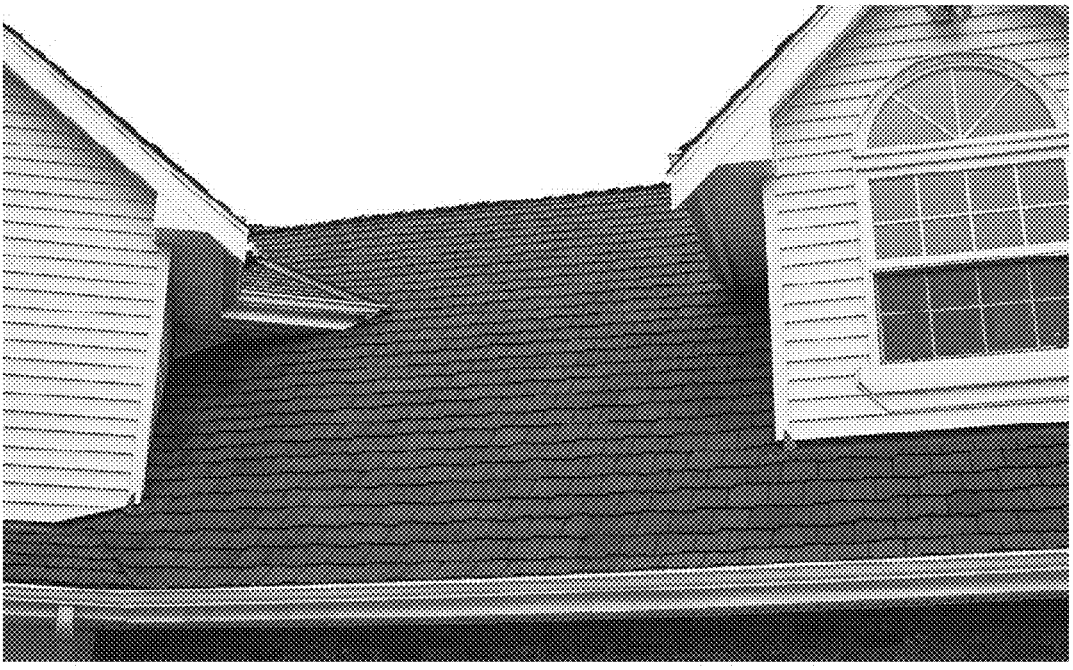
FIGS. 6A and 6B discloses exemplary roofs comprising the roofing shingles and patterns as discussed herein.
Figure 6B:
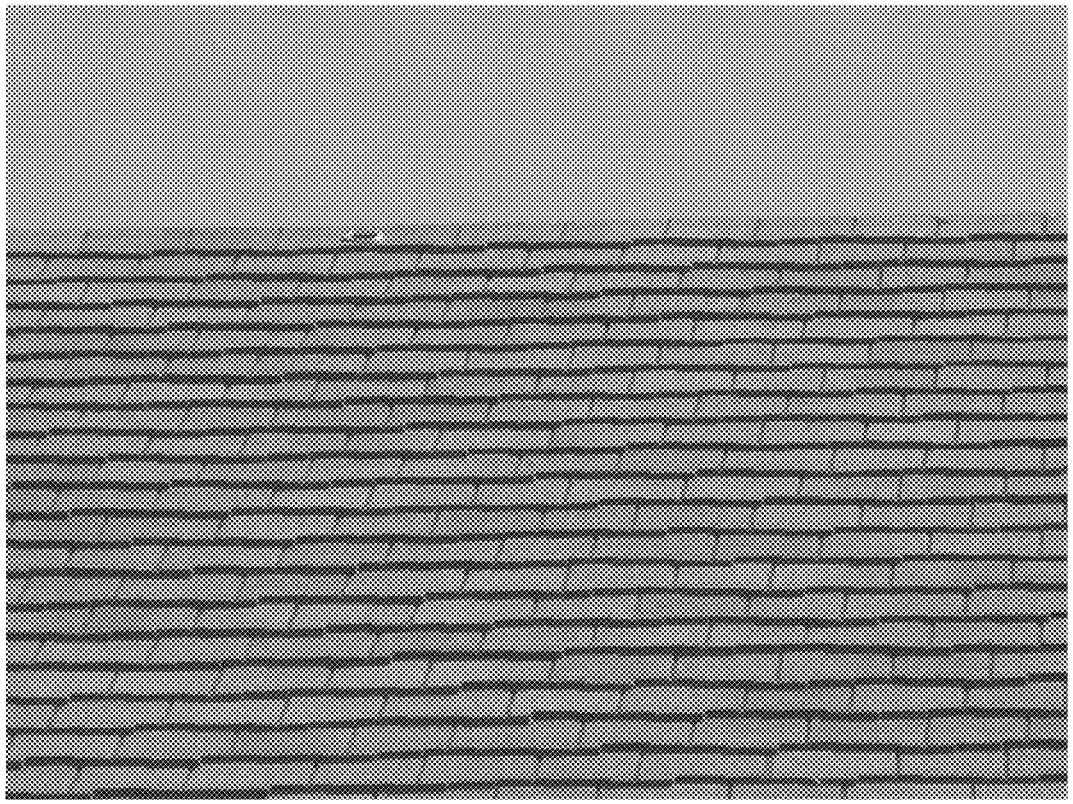

FIGS. 6A and 6B disclose a roof comprising a roofing shingles according to the present invention, wherein besides the pattern resulting from the roofing shingle design, the appearance of wood shingles is further supported by the variation of colors between different tabs in a roofing shingle. The shingles were installed on the roof in a stair step fashion with a 5 inch lateral offset to the left for each overlying course. The installation had alternating type A and type B shingles moving up the roof to the left with the next adjacent shingle restarting the cycle of A and B shingles with a degree of randomness introduced by a dependence on which shingle was next in a given bundle when beginning the lowest most course of shingles. FIGS. 6A and 6B are photographs of different portions of the same roof under different lighting conditions that help visualize the color blend variation differences in the shingles in the shingle array on the roof.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the orders in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A roofing shingle assembly, comprising:

a first roofing shingle comprising an upper unexposed area and a lower exposed area with a lower edge having an uneven profile; and a second roofing shingle comprising an upper unexposed area and a lower exposed area with a lower edge having an uneven profile;

wherein the roofing shingle assembly further comprises the first roofing shingle joined to the second roofing shingle along a common join line, such that the lower edges of each of the first shingle and the second shingle are joined and in contact along the common join line;

wherein each of the first roofing shingle and the second roofing shingle comprises a plurality of slots extending from the lower edge toward the upper unexposed area to define at least a first tab and a second tab; and wherein at least one pair of adjacent slots in the first roofing shingle is not contiguous with an adjacent pair of adjacent slots in the second roofing shingle along the common join line in the roofing shingle assembly.

2. The roofing shingle assembly according to claim 1, wherein the uneven profiles comprise a symmetry element selected from the group of an axis of rotation, a mirror plane, a center of inversion, or any combination thereof.

3. The roofing shingle assembly according to claim 2, wherein the symmetry element is located at a midpoint of the uneven profiles.

4. The roofing shingle assembly according to claim 1, wherein the plurality of slots comprises at least n slots defining at least n+1 tabs, the n+1 tabs each having a width $w_1$ through $w_{n+1}$, wherein n is at least 2, and wherein the n+1 tabs include at least the first tab and the second tab.

5. The roofing shingle assembly according to claim 4, wherein at least one of the width $w_1$ through $w_{n+1}$ is unequal to another width.

6. The roofing shingle assembly according to claim 4, wherein each width $w_1$ through $w_{n+1}$ is at least about 5 inches.

7. The roofing shingle assembly according to claim 1, wherein at least one of the plurality of slots has a width $w_s$, wherein $w_s$ is at least about 0.05 inches, and wherein $w_s$ is not greater than about 1.1 inches.

8. The roofing shingle assembly according to claim 1, wherein the uneven profiles include a step profile, a rectangular profile, a trapezoidal profile, or a combination thereof.

9. A roofing shingle assembly comprising:

a first roofing shingle comprising an upper unexposed area, a lower exposed area, and a plurality of slots comprising at least n slots defining at least n+1 tabs that form a lower edge having an uneven profile; and a second roofing shingle comprising an upper unexposed area, a lower exposed area, and a plurality of slots comprising at least n slots defining at least n+1 tabs that form a lower edge having an uneven profile;

wherein the roofing shingle assembly further comprises the first roofing shingle joined to the second roofing shingle along a common join line, such that the lower edges of each of the first shingle and the second shingle are joined and in contact along the common join line;

wherein at least one pair of adjacent slots in the first roofing shingle is not contiguous with an adjacent pair of adjacent slots in the second roofing shingle along the common join line in the roofing shingle assembly.

10. The roofing shingle assembly according to claim 9, wherein each of the n+1 tabs has a width $w_1$ through $w_{n+1}$, wherein at least one of the width $w_1$ through $w_{n+1}$ is unequal to another width.

11. The roofing shingle assembly according to claim 10, wherein each width $w_1$ through $w_{n+1}$ is unequal to any other width of a tab of the same shingle.

12. The roofing shingle assembly according to claim 10, wherein each width $w_1$ through $w_{n+1}$ is not greater than about 10 inches.

13. The roofing shingle assembly according to claim 10, wherein at least one of the plurality of slots has a width $w_s$, wherein $w_s$ is at least about 0.05 inches, and wherein $w_s$ is not greater than about 1.1 inches.

14. The roofing shingle assembly according to claim 9, wherein each tab comprises a first uniform length and at least one offset having a second uniform length that varies from the first uniform length between +/−10%.

* * * * *